US009543049B2

(12) United States Patent
Clough et al.

(10) Patent No.: US 9,543,049 B2
(45) Date of Patent: Jan. 10, 2017

(54) APPARATUS FOR HOLDING RADIOACTIVE OBJECTS

(71) Applicant: ATOMIC ENERGY OF CANADA LIMITED / ÉNERGIE ATOMIQUE DU CANADA LIMITÉE, Chalk River (CA)

(72) Inventors: Malcolm James Clough, Pembroke, CA (US); Austin Thomas Jackson, Calgary, CA (US); Clifford John Joseph Dugal, Deep River, CA (US); Daniel Harry Martin, Petawawa, CA (US); James Edward Allan McGregor, Pembroke, CA (US); William Thomas Diamond, Deep River, CA (US)

(73) Assignee: ATOMIC ENERGY OF CANADA LIMITED / ÉNERGIE ATOMIQUE DU CANADA LIMITÉE, Chalk River (CA)

( * ) Notice: Subject to any disclaimer, the term of this patent is extended or adjusted under 35 U.S.C. 154(b) by 26 days.

(21) Appl. No.: 14/847,414

(22) Filed: Sep. 8, 2015

(65) Prior Publication Data

US 2016/0027541 A1 Jan. 28, 2016

Related U.S. Application Data

(63) Continuation of application No. 14/363,448, filed as application No. PCT/CA2012/050877 on Dec. 7, 2012, now abandoned.

(Continued)

(51) Int. Cl.

*G21F 5/10* (2006.01)
*G21F 5/012* (2006.01)

(Continued)

(52) U.S. Cl.

CPC ..... *G21F 5/10* (2013.01); *G21F 5/005* (2013.01); *G21F 5/008* (2013.01); *G21F 5/012* (2013.01); *G21F 5/015* (2013.01)

(58) Field of Classification Search

None

See application file for complete search history.

(56) References Cited

U.S. PATENT DOCUMENTS 3,086,600 A 4/1963 Kerley, Jr.
3,104,219 A 9/1963 Sulzer (Continued)

FOREIGN PATENT DOCUMENTS

EP 0896721 B1 1/2003
FR 2737598 A1 2/1997

(Continued)

OTHER PUBLICATIONS

Malcolm Clough and Austin Jackson, An Investigation into the Transportation of Irradiated Uranium/Aluminum Targets from a Foreign Nuclear Reactor to the Chalk River Laboratories Site in Ontario, Canada—12249, WM2012 Conference, 2012, Phoenix, Arizona, USA.

(Continued)

*Primary Examiner* — Michael Logie

(74) *Attorney, Agent, or Firm* — Bereskin & Parr LLP/S.E.N.C.R.L., s.r.l.

(57) ABSTRACT

An apparatus for holding radioactive objects includes a base and a central pillar extending upwardly between a bottom end coupled to the base and a top end above the base. A plurality of inner segments are spaced around the central pillar, and a plurality of outer segments are spaced around the inner segments to form pairs. The inner segments, the outer segments and the central pillar may be coupled together to permit limited radial movement of at least one of (Continued)

the segments of each pair. Each pair may define a generally vertical, object-receiving channel arranged between the inner and outer segment of the pair. The segments of each pair may be adapted to bear against an object in the channel of the pair to laterally restrain the object and facilitate heat transfer from the object.

25 Claims, 6 Drawing Sheets

Related U.S. Application Data

(60) Provisional application No. 61/568,280, filed on Dec. 8, 2011.

(51) Int. Cl.

| | |
|---|---|
| ***G21F 5/005*** | (2006.01) |
| ***G21F 5/008*** | (2006.01) |
| ***G21F 5/015*** | (2006.01) |

(56) References Cited

U.S. PATENT DOCUMENTS

| | | | | |
|---|---|---|---|---|
| 3,111,586 | A | 11/1963 | Rogers | |
| 3,179,243 | A | 4/1965 | Ashcroft | |
| 3,466,445 | A * | 9/1969 | Schlies | G21F 5/012 250/507.1 |
| 3,493,756 | A | 2/1970 | Latzer | |
| 3,787,699 | A * | 1/1974 | Menachem | G21K 5/08 250/507.1 |
| 3,886,368 | A | 5/1975 | Rollins et al. | |
| 4,139,778 | A * | 2/1979 | Raymond | G21C 19/07 376/272 |
| 4,152,602 | A | 5/1979 | Kaminski et al. | |
| 4,292,528 | A | 9/1981 | Shaffer et al. | |
| 4,372,520 | A | 2/1983 | Shutt | |
| 4,393,510 | A | 7/1983 | Lang et al. | |
| 4,447,729 | A | 5/1984 | Doroszlai et al. | |
| 4,456,827 | A | 6/1984 | Botzem et al. | |
| 4,522,780 | A | 6/1985 | Shallenberger et al. | |
| 4,535,250 | A | 8/1985 | Fields | |
| 4,634,875 | A | 1/1987 | Kugeler et al. | |
| 4,636,351 | A | 1/1987 | Rohr | |
| 4,649,018 | A | 3/1987 | Waltersdorf et al. | |
| 4,650,639 | A | 3/1987 | Coussau | |
| 4,680,159 | A | 7/1987 | Lahr et al. | |
| 4,692,304 | A | 9/1987 | Gjertsen | |
| 4,783,309 | A | 11/1988 | Popp et al. | |
| 4,820,475 | A | 4/1989 | Mayers et al. | |
| 4,877,969 | A * | 10/1989 | James | G21F 5/10 250/507.1 |
| 5,035,342 | A * | 7/1991 | Houghton | G21F 5/012 220/23.2 |
| 5,408,509 | A | 4/1995 | Ruzga et al. | |
| 5,471,514 | A | 11/1995 | Söderlund | |
| 5,504,343 | A | 4/1996 | Besnier | |
| 5,781,355 | A | 7/1998 | Meier | |
| 6,134,290 | A | 10/2000 | Yoshizawa et al. | |
| 6,452,994 | B2 | 9/2002 | Pennington | |
| 6,873,673 | B2 | 3/2005 | Georgii | |
| 8,039,824 | B2 | 10/2011 | Grinder et al. | |
| 2002/0041788 | A1 | 4/2002 | Look et al. | |
| 2003/0167735 | A1 * | 9/2003 | Georgii | B28B 23/00 53/452 |
| 2004/0196953 | A1 | 10/2004 | Kim et al. | |
| 2006/0043320 | A1 * | 3/2006 | Nicholson | G21C 19/40 250/506.1 |
| 2010/0111243 | A1 | 5/2010 | Monchanin et al. | |
| 2010/0119029 | A1 | 5/2010 | Viallon et al. | |
| 2010/0284506 | A1 | 11/2010 | Singh | |

FOREIGN PATENT DOCUMENTS

| | | | |
|---|---|---|---|
| WO | 9742636 | A1 | 11/1997 |
| WO | 2013082720 | A1 | 6/2013 |

OTHER PUBLICATIONS

International Search Report issued Mar. 8, 2013 in respect of International Application No. PCT/CA2012/050877.

International Preliminary Report on Patentability issued Jun. 10, 2014 in respect of International Application No. PCT/CA2012/050877.

Extended European Search Report issued Jun. 15, 2015 in respect of European Application No. 12855380.7.

Non-Final Rejection issued Feb. 13, 2015 in respect of U.S. Appl. No. 14/363,448.

Notice of Allowance issued Jun. 8, 2015 in respect of U.S. Appl. No. 14/363,448.

Corrected Notice of Allowability issued Jul. 14, 2015 in respect of U.S. Appl. No. 14/363,448.

* cited by examiner

A - A

APPARATUS FOR HOLDING RADIOACTIVE OBJECTS

CROSS-REFERENCE TO RELATED APPLICATIONS

This is a continuation of U.S. application Ser. No. 14/363,448 filed Jun. 6, 2014, which is a national stage application of International Application No. PCT/CA2012/050877 filed Dec. 7, 2012, which claims priority to U.S. Application No. 61/568,280 filed Dec. 8, 2011, and the entire contents of each are hereby incorporated herein by reference.

FIELD

The present disclosure relates to apparatuses for holding objects. The present disclosure also relates to nuclear technology.

BACKGROUND

The following is not an admission that anything discussed therein is prior art or part of the knowledge of persons skilled in the art.

Isotopes used in nuclear medicine may be produced through a process that includes irradiation of uranium targets in a nuclear reactor. Targets may be fabricated in a variety of shapes, and may be cladded in aluminum or other metal to protect the chemically reactive uranium metal or alloy and contain the fission products produced during irradiation. For example, targets may be shaped as narrow cylinders, with a diameter similar to a large pencil, and formed of a uranium aluminum alloy with aluminum cladding.

INTRODUCTION

The following is intended to introduce the reader to the detailed description that follows and not to define or limit the claimed subject matter.

In an aspect of the present disclosure, an apparatus for holding radioactive objects may include: a base; a central pillar extending upwardly between a bottom end coupled to the base and a top end above the base; a plurality of inner segments spaced around the central pillar; and a plurality of outer segments spaced around the inner segments to form pairs, wherein the inner segments, the outer segments and the central pillar are coupled together to permit limited radial movement of at least one of the segments of each pair, wherein each pair defines a generally vertical, object-receiving channel arranged between the inner and outer segment of the pair, and wherein the segments of each pair are adapted to bear against an object in the channel of the pair to laterally restrain the object and facilitate heat transfer from the object.

Each of the inner segments may be adapted to move generally radially with respect to the central pillar. The apparatus may further include at least one fastening element coupling each of the inner segments with the central pillar. The at least one fastening element may be received in a bore formed in the inner segment. Each of the inner segments may include a drainage conduit extending between top and bottom surfaces of the inner segment, and the drainage conduit may be in fluid communication with the bore.

Each of the inner segments may be biased outwardly with respect to the central pillar. The apparatus may further include at least one spring element arranged between each of the inner segments and the central pillar to bias the inner segments outwardly.

Each of the outer segments may be adapted to move generally radially with respect to the central pillar. The apparatus may further include at least one fastening element coupling each of the outer segments with the respective one of the inner segments. The at least one fastening element may be received in a bore formed in the outer segment. Each of the outer segments may include a drainage conduit extending between top and bottom surfaces of the outer segment, and the drainage conduit may be in communication with the bore.

Each of the outer segments may be biased outwardly with respect to the central pillar. The apparatus may further include at least one spring element arranged between each of the outer segments and the respective one of the inner segments to bias the outer segment outwardly.

Each of the channels may include a beveled top opening to facilitate loading of the objects into the channels. The channels may be connected by a first annular space that extends around the central pillar between the inner segments and the outer segments. The apparatus may further include a second annular space that extends around the central pillar between the central pillar and the inner segments.

The apparatus may further include a radial gap extending between each of the pairs of segments and an adjacent pair. Each of the outer segments may include chamfered side faces, so that the radial gap extends radially outwardly into a generally triangular passage. The central pillar may include a drainage passage extending between the top and bottom ends. The central pillar may include a plurality of drainage ports extending generally radially between the drainage passage and an outer surface adjacent to the inner segments. The top end of the central pillar may be adapted for attachment to a handling tool.

In an aspect of the present disclosure, an apparatus for holding radioactive objects may include a base, a central pillar extending upwardly between a bottom end coupled to the base and a top end above the base, a plurality of inner segments spaced around the central pillar, and a plurality of outer segments spaced around the inner segments to form pairs, wherein the central pillar, the inner segments and the outer segments are coupled together to permit limited radial movement of the inner and outer segments, wherein each of the segments is biased radially outwardly, and wherein each pair defines a generally vertical, object-receiving channel arranged between the inner and outer segment of the pair. A cask may include a generally cylindrical inner wall enclosing an interior space for receiving the apparatus, the interior space being sized and shaped so that the inner wall bears against the outer segments, wherein radially inward displacement of the outer segments of each pair causes the segments to bear against an object in the channel of the pair to laterally restrain the object and facilitate heat transfer between the object, the segments, and the cask. Each of the outer segments may include a tapered outer face adjacent to the base to facilitate loading of the apparatus into the cask.

In an aspect of the present disclosure, an apparatus for holding a plurality of elongate, radioactive objects, may include a pair of segments for each of the objects, each pair defining a channel with the object received therein, the segments of each pair being adapted to bear against the object in the channel to laterally restrain the object and facilitate heat transfer from the object.

In an aspect of the present disclosure, an apparatus for holding radioactive objects may include: at least two segments for each of the objects, the segments defining a channel with the object received therein; and a wall bearing against at least one of the segments for each object, wherein displacement of the segments by the wall causes the segments to bear against the object to restrain the object and facilitate heat transfer from the object.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

After irradiation, it may be desirable to transport uranium/aluminum target "pencils" between the nuclear reactor and a site remote from the nuclear reactor, for subsequent processing while the targets are still highly radioactive. However, over an extended travel period, if the targets have a significant decay power there is a risk that the temperature may increase above a desired operating temperature if a satisfactory heat sink is not available. There is even a risk of the cladding of the targets melting.

Figure 1:
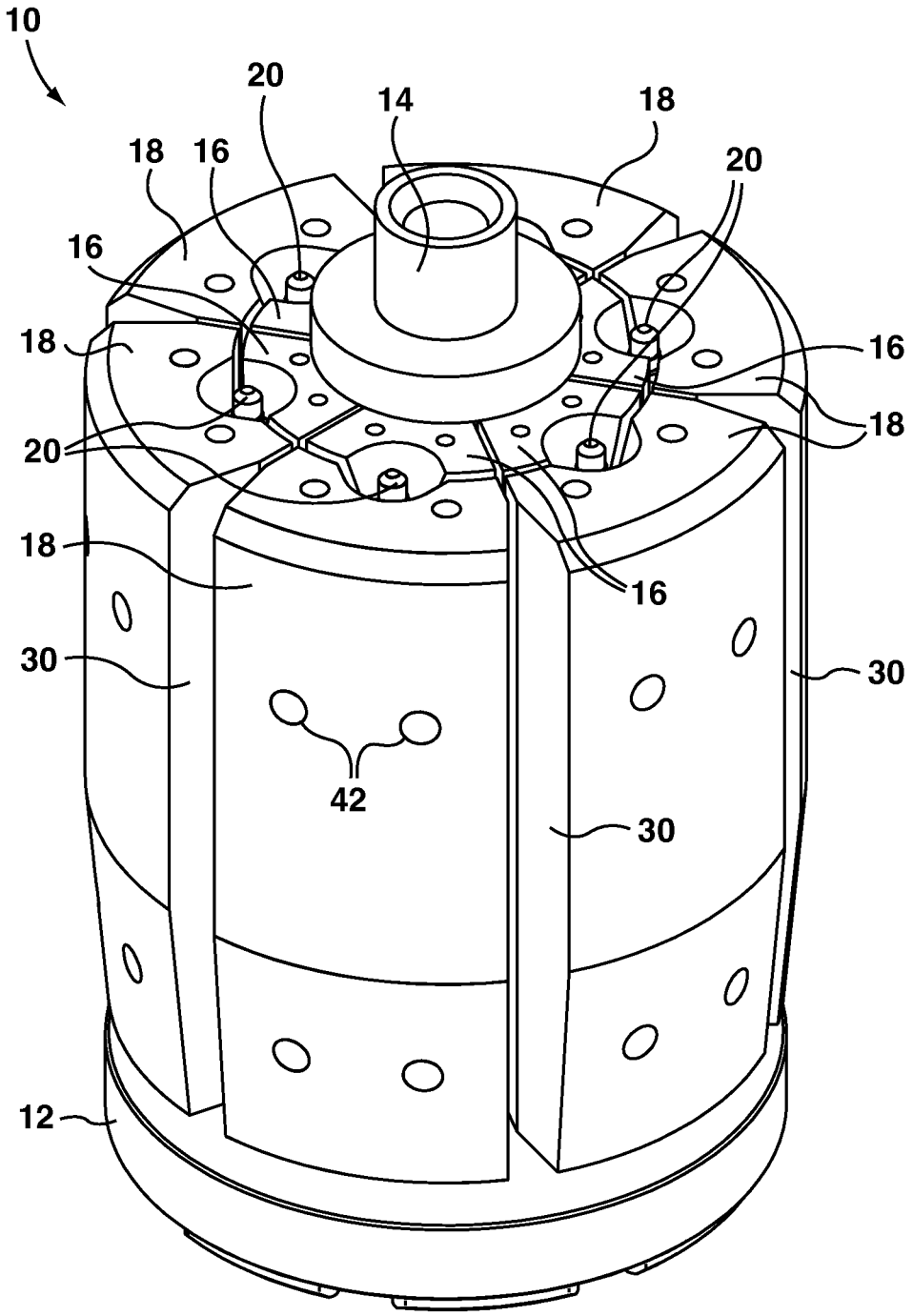
FIG. 1 is a perspective view of an example of an apparatus, shown holding radioactive objects.

Referring to FIG. 1, an apparatus for holding radioactive objects (for example, uranium/aluminum target "pencils") is shown generally at reference numeral 10. The apparatus 10 includes a base 12, and a central pillar 14 extending upwardly from the base 12. A series of inner segments 16 are radially spaced around the central pillar 14. A series of outer segments 18 are radially (with respect to the central pillar 14) spaced around the inner segments 16. Each of the outer segments 18 is coupled to a respective one of the inner segments 16 to form a pair. As described in further detail below, each pair of the segments 16, 18 defines a generally vertical, object-receiving channel arranged between the segments 16, 18 of the pair. The elongate radioactive objects, which are identified by reference numeral 20, are received and laterally restrained within these channels.

Figure 2:
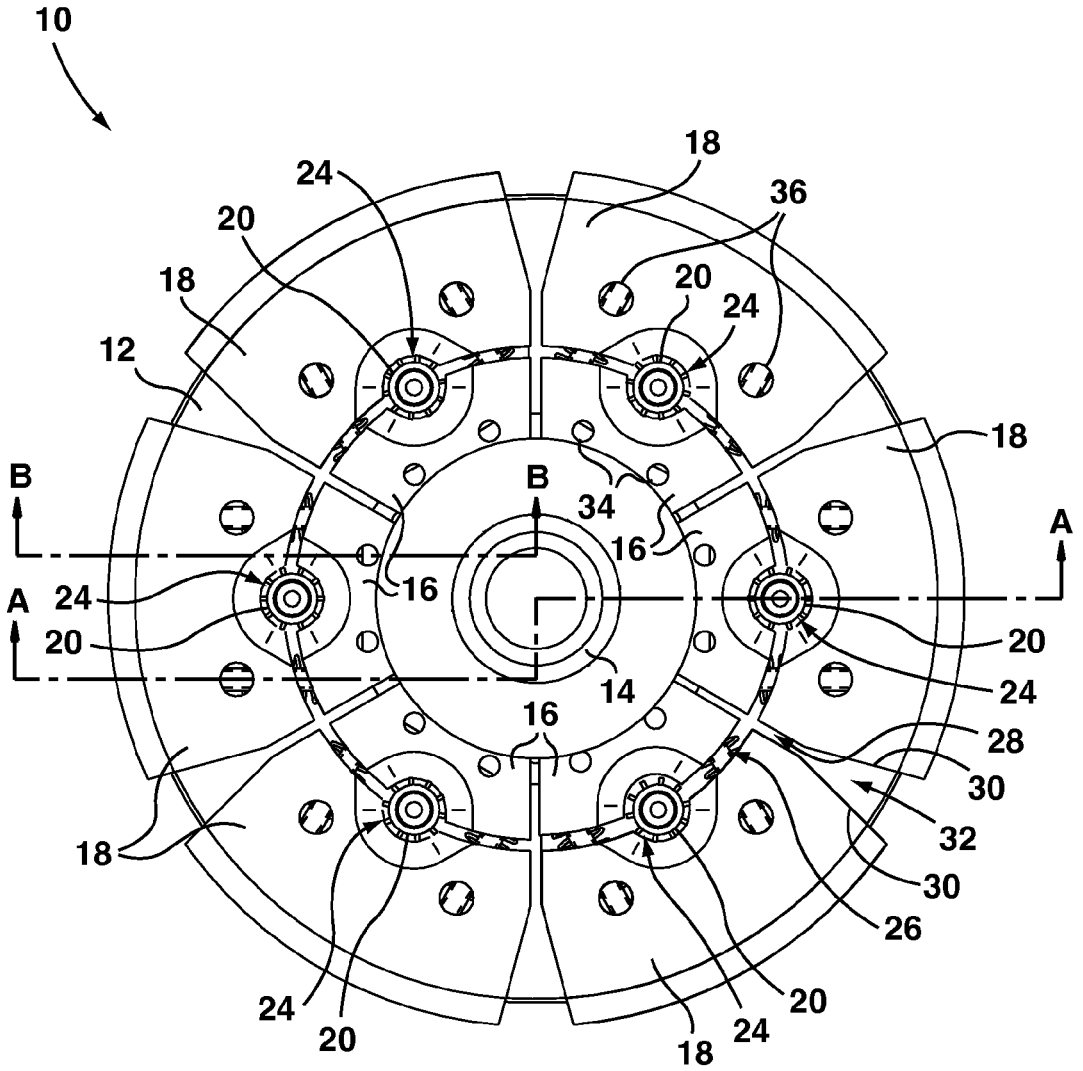
FIG. 2 is a top view of the apparatus and the objects of FIG. 1.

Referring now to FIG. 2, the segments 16, 18 are shown to be concentrically arranged with respect to the central pillar 14, and spaced around the central pillar 14 equidistantly. In the example illustrated, there are six pairs of the segments 16, 18, but the number of pairs may vary depending on the particular configuration. The channels, which are identified by reference numeral 24, are each formed of a pair of the segments 16, 18, and accordingly six of the objects 20 are shown received in the channels 24. In the example illustrated, the channels 24 are cylindrical in shape. The shape of the channels 24, defined by the inner and outer segments 16, 18 in a pair, may be selected to be generally complementary to the shape of the object 20 along its length so as to ensure good contact between the channels 24 and the objects 20.

The channels 24 are shown connected by a first annular space 26 that extends around the central pillar 14 between the inner segments 16 and the outer segments 18. The first annular space 26 permits movement between the segments 16, 18, e.g., to make the channels 24 larger to accept the objects 20 of varying size, according to production tolerances. The first annular space 26 also provides for drainage and the flow of gas within the apparatus 10. Gas flow within the apparatus 10 may be useful in the transfer of heat away from the objects 20, whether by active drying or by natural convection, or both. In some examples, air may be used as a gas within and around the apparatus 10. However, other gases may be used, e.g., helium.

A radial gap 28 may extend between each of the pairs of segments 16, 18 and an adjacent pair. The radial gap 28 intersects with the first annular space 26, and provides another path for drainage and gas flow. As illustrated, each of the outer segments 18 may include chamfered side faces 30, so that the radial gap 28 extends radially outwardly into an elongate passage 32 having a generally triangular cross section. The side faces 30 are also shown in FIG. 1.

The inner segments 16 may include drainage conduits 34, and the outer segments 18 may include drainage conduits 36. In the example illustrated, each of the segments 16, 18 include two of the drainage conduits 34, 36, respectively.

Figure 3:
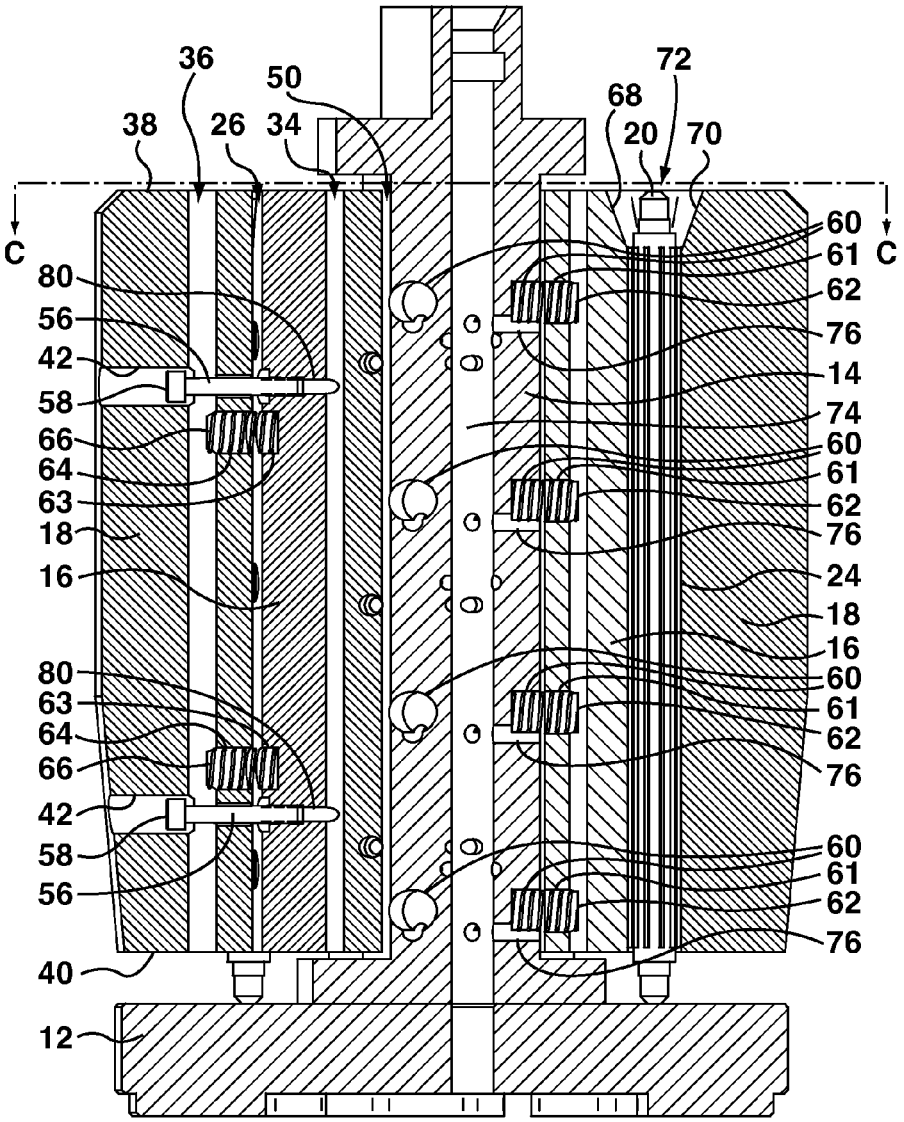
FIG. 3 is a sectional view along line A-A in FIG. 2.
Figure 4:
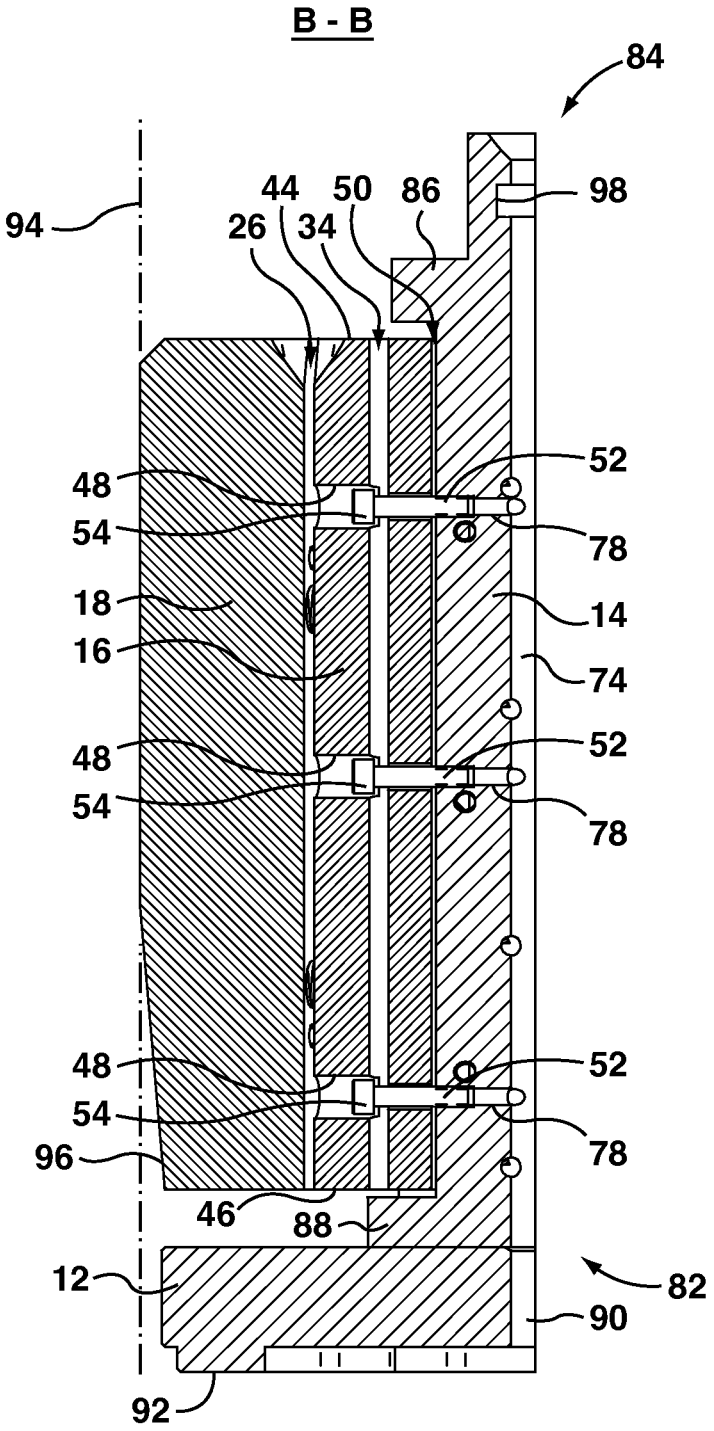
FIG. 4 is a sectional view along line B-B in FIG. 2.

As shown in FIG. 3, the drainage conduits 36 extend between a top surface 38 of the outer segment 18, and a bottom surface 40. The drainage conduits 36 are in fluid communication with bores 42 formed in the outer segments 18. The bores 42 are also shown in FIG. 1. Similarly, as shown in FIG. 4, the drainage conduits 34 extend between a top surface 44 of the inner segment 16, and a bottom surface 46. The drainage conduits 34 are in fluid communication with bores 48 formed in the inner segments 16. The drainage conduits 34, 36 allow for drainage of fluid and permit gas flow through the segments 16, 18, respectively.

Although not shown, the top surfaces 38, 44 may be sloped to encourage drainage of water away from the apparatus 10.

With continued reference to FIG. 4, a second annular space 50 extends around the central pillar 14 between the central pillar 14 and the inner segments 16. The bores 48 formed in the inner segments 16 receive fastening elements 52, which are fixed to the central pillar 14. Heads 54 of the fastening elements 52 are received within their respective bore 48, and the bore 48 may travel relative to the head 54 so that each of the inner segments 16 is capable of limited radial movement with respect to the central pillar 14. The size of the second annular space 50 depends on the position of each of the inner segments 16 relative to the central pillar 14. Although not shown, the radial gap 28 (see FIG. 2) may also intersect with the second annular space 50 to provide drainage and gas flow therebetween.

Referring again to FIG. 3, the bores 42 formed in the outer segments 18 receive fastening elements 56, which are fixed to a respective one of the inner segments 16. Heads 58 of the fastening elements 56 are received within their respective bore 42, and the bore 42 may travel relative to the head 58 so that each of the outer segments 18 is capable of limited radial movement with respect to the central pillar 14.

In some examples, at least one of the segments 16, 18 of each pair is biased towards the other so that the segments 16, 18 laterally bear against the object 20 to restrain the object in the channel 24, and facilitate heat transfer between the object 20 and the segments 16, 18.

In the example illustrated, with continued reference to FIG. 3, the central pillar 14 includes pockets 60, and an inner portion of the inner segments includes pockets 61, each of which is aligned with a respective one of the pockets 60. The pockets 60 connect with the second annular space 50, and the pockets 61 connect between the second annular space 50 and the drainage conduit 34, permitting drainage and gas flow therebetween. Each pair of the pockets 60, 61 receives a spring element 62, which may be preloaded. The spring elements 62 are arranged in parallel between each of the inner segments 16 and the central pillar 14, and bias the inner segments 16 outwardly.

Similarly, an outer portion of the inner segments 16 include pockets 63, and an inner portion of the outer segments 18 include pockets 64, each of which is aligned with a respective one of the pockets 63. The pockets 63 connect with the first annular space 26, and the pockets 64 connect between the first annular space 26 and the drainage conduit 36, permitting drainage and gas flow therebetween. Each pair of the pockets 63, 64 receives a spring element 66, which may be preloaded. The spring elements 66 are arranged between the inner and outer segments 16, 18 and bias the outer segments 18 outwardly, e.g., for engagement with an inner wall of a cask (described in further detail below).

It should be appreciated that the spring elements 62, 66 are selected so that they have sufficient lateral force to restrain the objects 20, and provide good contact between the objects 20 and the segments 16, 18 for thermal conduction, but not exert excessive force to damage the objects 20.

Furthermore, the spring elements 62, 66 may be arranged to provide biasing force generally uniformly across and along the segments 16, 18 (i.e. between the top surfaces 44, 38 and the bottom surfaces 46, 40, respectively). In the example illustrated, there are four spring elements 62 per each of the inner segments 16, arranged in a row, and there are four spring elements 66 per each of the outer segments 18, in a 2×2 arrangement. The spring elements 62, 66 may be arranged in various patterns.

Moreover, biasing force on the segments 16, 18 may be varied in a number of ways, including, for example, by altering the depth of the pockets 60, 63 to vary the degree in which the respective spring elements 62, 66 are preloaded, by varying the spring strength of each of the spring elements 62, 66, and by varying the number of spring elements 62, 66 per respective segment 16, 18. Spring forces biasing the segments 16, 18 outwardly may be selected to both cause the segments 16, 18 to bear against the objects 20 and cause the segments 18 to bear against the inner wall of the cask.

Although not shown in the drawings, the apparatus 10 may optionally include one or more temperature measuring devices for monitoring various temperatures of the apparatus 10.

FIG. 3 also shows that the inner and outer segments 16, 18 each include bevel surfaces 68, 70, respectively, which form a beveled top opening 72 that makes it easier to load the objects 20 into the channels 24.

The central pillar 14 includes a generally vertical drainage passage 74, and a series of drainage ports 76 connected to the drainage passage 74. As illustrated, the drainage ports 76 may be formed underneath the pockets 60, and may extend radially between the drainage passage 74 and an outer surface of the central pillar 14 adjacent to the inner segments 16.

Referring again to FIG. 4, each of the fastening elements 52 is fixed in an aperture 78 formed in the central pillar 14. The aperture 78 is shown connected to the drainage passage 74. Similarly, as shown in FIG. 3, the fastening elements 56 are shown fixed in an aperture 80 formed in an outer portion of the inner segment 16. The aperture 80 is shown connected to the drainage conduit 34.

Once again, reference is made to FIG. 4. The central pillar 14 extends upwardly from the base 12 between a bottom end 82 coupled to the base 12 and a top end 84 above the base 12. Towards the top end 84, the central pillar 14 includes a top flange 86, which may be used to support and separate the apparatus 10 from a spacer in the cask, for example. Towards the bottom end 82, the central pillar 14 includes a bottom flange 88, which is mounted to the base 12. Alternatively, the base 12 and the central pillar 14 could be integrated as a one-piece structure. The base 12 includes a drainage outlet 90, which is aligned and in fluid communication with the drainage passage 74 (which in turn may be aligned with an outlet in the bottom wall of the cask).

As seen in FIG. 4, the chain dot line identified by reference numeral 94 represents an inner surface of a generally cylindrical inner wall of a cask, which encloses an interior space for receiving the apparatus 10. Casks are known in the nuclear industry, and typically take the form of a cylindrical stainless steel container, having the inner wall and a cylindrical outer wall defining an annular space therebetween. The annular space may be filled with lead or another shielding material. The cask is sealed shut with a top lid to shield and protect its contents. As mentioned above, the bottom wall may include an outlet, for drainage and gas flow. The cask may also include an inlet (e.g., located on the lid), allowing for liquid or gas to be directed into the cask (even when sealed). For example, an active drying gas may be directed through the cask between the inlet and the outlet.

The cask may be sized and shaped so that the surface 94 bears against the outer segments 18 to restrain the object in the channel. The outer segments 18 are shown to include a tapered outer face 96, adjacent to the base 12, to facilitate loading the apparatus 10 into the cask. An outer circumference of the base 12 is sized to be roughly the same as a leading edge of the tapered outer face 96 of the outer segments 18.

Engagement between the surface 94 and the outer segments 18 also generally facilitates heat transfer between the segments 18 and the cask. Although not shown, in some examples the outer segments 18 may include outer rib elements arranged to engage the surface 94, while also providing space between the surface 94 and the outer segments 18 for drainage and gas flow purposes.

FIGS. 1 to 4 show the apparatus 10 in a closed position. In the closed position, the segments 16, 18 bear against the objects 20. However, to avoid overstressing of the objects 20, there may be additional spring compression remaining. The spring load in the closed position restrains the objects 20 and provides enhancement of conductive heat transfer between both the object-to-segment and segment-to-cask surfaces.

Before the apparatus 10 is inserted into the cask or otherwise moved into the closed position, the apparatus 10 may be disposed in an open position in which the segments 16, 18 in each pair are spaced apart generously, simply by permitting the spring elements 62, 66 to display the segments 16, 18 radially outwardly, without restraint. The objects 20 may then be loaded into the channels 24 relatively easily. After the objects 20 are inserted into the channels 24, e.g., by force of gravity, the apparatus 10 may be inserted into the cask, causing the surface 94 to bear against the leading edge of the tapered outer face 96 of the outer segments 18, thereby compressing the spring elements 62, 66. As the surface 94 is displaced along the tapered outer face 96, the segments 16, 18 are progressively displaced radially inwards, to bear against the objects 20.

Figure 5A:
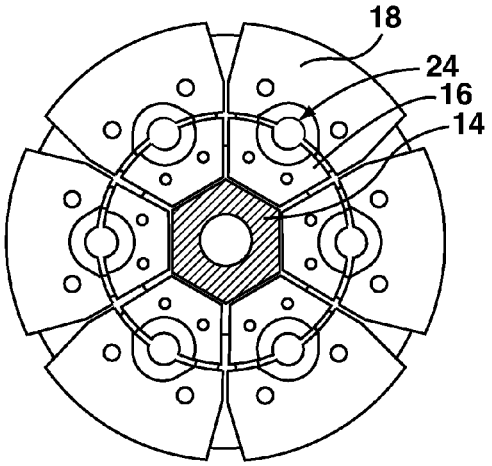
FIG. 5A is a sectional view along line C-C in FIG. 3, in which the apparatus of FIG. 1 is shown in a closed position.
Figure 5B:
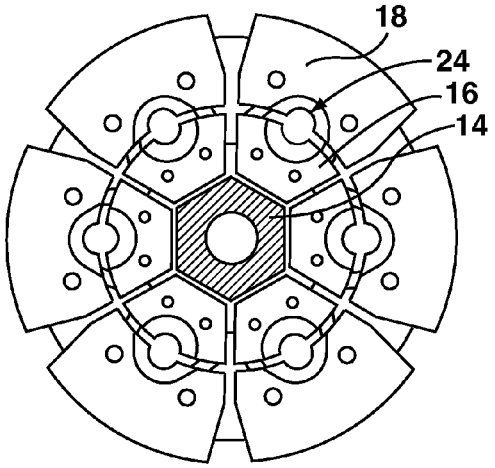
FIG. 5B is another sectional view of the apparatus of FIG. 1, shown in an open position.

FIGS. 5A and 5B show the apparatus 10 in the closed and open positions, respectively, and without objects in the channels 24. As seen in FIGS. 5A and 5B, the central pillar 14 may be hexagonal in cross section.

Figure 5C:
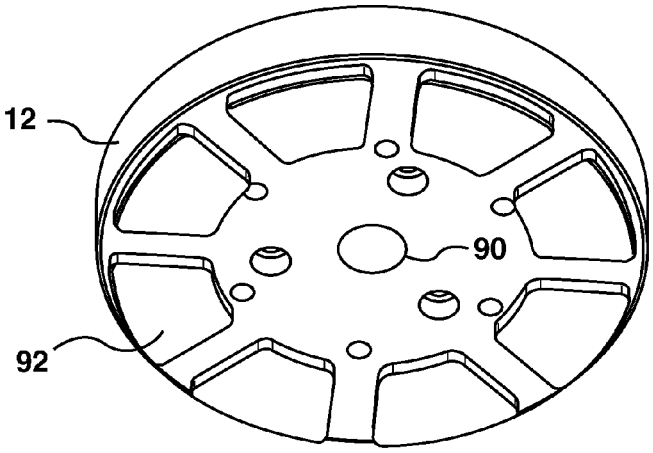
FIG. 5C is a bottom perspective view of a base of the apparatus of FIG. 1.

Referring to FIG. 5C, the base 12 includes one or more ground engaging feet 92, which are spaced apart from the drainage outlet 90. The feet 92 elevate the base 12 off of a bottom wall of the cask or a ground surface (not shown), so that the drainage outlet 90 is not clogged to discharge fluid from the apparatus 10, and also provides for gas flow. As illustrated, the base 12 may include additional drainage holes.

Figure 6A:
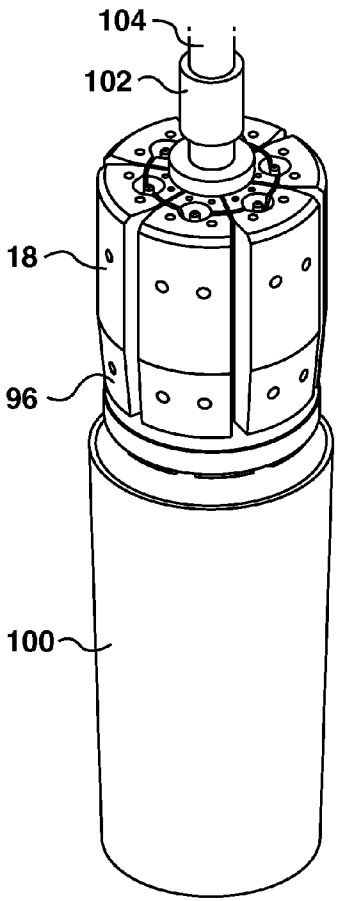
FIGS. 6A, 6B and 6C show the apparatus of FIG. 1 being inserted into an inner wall of a cask.
Figure 6B:
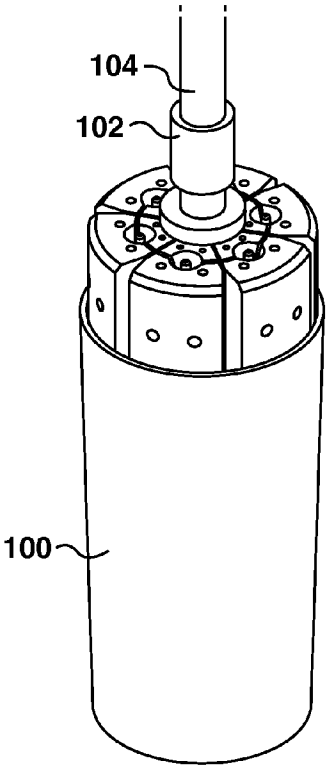
Figure 6C:
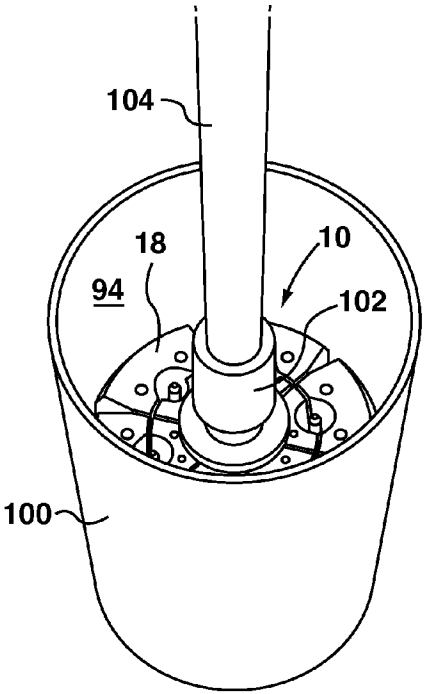

FIGS. 6A to 6C illustrate the apparatus being loaded into a cylindrical inner wall 100 of a cask using a handling tool. The inner wall 100 of the cask is shown without the outer wall and lining, which tends to have significant thickness dimension. In FIG. 6A, the apparatus 10 is aligned with an opening of the inner wall 100, to engage a leading edge of the tapered outer faces 96 with an upper edge of the inner wall 100. In FIG. 6B, the apparatus has been partially inserted into the inner wall 100. In FIG. 6C, the apparatus 10 is fully received by the inner wall 100, and with the surface 94 bearing against the segments 18.

In the example illustrated, the handling tool includes a connection mechanism 102 disposed at one end of an elongate handle 104. The handling tool may be used in combination with the apparatus 10 to manipulate the apparatus 10, e.g., into and out of the inner wall 100.

Referring again to FIG. 4, adjacent to the top end 84 of the central pillar 14, the drainage passage 74 may include an annular groove 98. In some examples, the connection mechanism 102 may include a ball lock pin (not shown), which is configured to engage the annular groove 98 to lock the handling tool onto the apparatus 10. As shown, a beveled surface may also be provided leading into the drainage passage 74, to make it easier to engage the ball lock pin with the annular groove 98.

The inventors developed the apparatuses described herein as a relatively simple solution for transporting irradiation targets, particularly uranium/aluminum target "pencils". The apparatuses are well-suited for this purpose for a number of reasons.

Firstly, for example, the target-receiving channels are relatively large when the apparatus is in the open position. The apparatuses therefore allow for ample clearance for the irradiated targets to be inserted during loading and unloading, which may be a requirement since the targets may be stored underwater, and have to be transferred remotely underwater and inserted into the apparatus.

Secondly, the apparatuses restrain the targets securely in place, preventing them from moving around during transport. Impact and fretting damage to the targets may be avoided, along with pinching and crushing of the targets. The apparatuses may also accommodate targets of slightly varying size, and bent targets.

Thirdly, in addition to restraining the targets, the apparatuses facilitate thermal contact between the targets, the apparatus, and the cask, and provide gas flow within and around the apparatus for dissipation of heat. Heat transfer, via conduction or convection, may be important because the irradiated targets continue to produce heat. Furthermore, it should be appreciated that the apparatuses may be passive devices that enable the transfer of heat from the targets, as opposed to actively controlled systems having temperature controls, pressure controls and related instrumentation, for example. Nevertheless, the apparatuses may be integrated into an actively controlled system.

Fourthly, the apparatuses includes drainage means to reduce the presence of water. The targets may be loaded into the cask under water. Water present once the cask is sealed and ready for shipping could turn to pressurized steam and threaten the integrity of the seals. Water is also a moderator, and thus care should be exercised when water and fissile materials are in proximity if there is the possibility of a chain reaction.

For the purposes of transporting irradiation targets, components of the apparatus 10, particularly the segments 16, 18, may be formed of aluminum, due to its relatively high thermal conductivity and its ability to cope in radioactive fields.

The total number of targets transported in the same cask may be governed by one or more radioactive shipment regulations (see, for example, safety standards established by the International Atomic Energy Agency), and may be based on a maximum total amount of fissile material within the cask. In the apparatuses described herein, the inventors selected the number of targets at six. However, this is not intended to be limiting, and the apparatus may be configured to transport more than six objects, or less than six objects. Various configurations are possible.

Although the present disclosure describes holding apparatuses particularly in the context of transporting irradiated targets, it should be appreciated that the holding apparatuses may be used in conjunction with various other radioactive objects. Other applications of the teachings herein are contemplated.

While the above description provides examples of one or more processes or apparatuses, it will be appreciated that other processes or apparatuses may be within the scope of the accompanying claims.

We claim:

1. An apparatus for holding radioactive objects, comprising:

a base;

a central pillar extending upwardly between a bottom end coupled to the base and a top end above the base;

a plurality of inner segments spaced around the central pillar; and a plurality of outer segments spaced around the inner segments to form pairs, wherein the inner segments, the outer segments and the central pillar are coupled together to permit limited radial movement of at least one of the segments of each pair, wherein each pair defines a generally vertical, object-receiving channel arranged between the inner and outer segment of the pair, wherein the segments of each pair are adapted to bear against an object in the channel of the pair to laterally restrain the object and facilitate heat transfer from the object, and wherein the channels are connected by a first annular space that extends around the central pillar between the inner segments and the outer segments.

2. The apparatus of claim 1, wherein each of the inner segments is adapted to move generally radially with respect to the central pillar.

3. The apparatus of claim 2, further comprising at least one fastening element coupling each of the inner segments with the central pillar.

4. The apparatus of claim 3, wherein the at least one fastening element is received in a bore formed in the inner segment.

5. The apparatus of claim 4, wherein each of the inner segments comprises a drainage conduit extending between top and bottom surfaces of the inner segment, and the drainage conduit is in fluid communication with the bore.

6. The apparatus of claim 5, wherein each of the outer segments is adapted to move generally radially with respect to the central pillar.

7. The apparatus of claim 6, further comprising at least one fastening element coupling each of the outer segments with the respective one of the inner segments.

8. The apparatus of claim 7, wherein the at least one fastening element is received in a bore formed in the outer segment.

9. The apparatus of claim 8, wherein each of the outer segments comprises a drainage conduit extending between top and bottom surfaces of the outer segment, and the drainage conduit is in communication with the bore.

10. The apparatus of claim 2, wherein each of the inner segments is biased outwardly with respect to the central pillar.

11. The apparatus of claim 10, further comprising at least one spring element arranged between each of the inner segments and the central pillar to bias the inner segments outwardly.

12. The apparatus of claim 1, wherein each of the outer segments is adapted to move generally radially with respect to the central pillar.

13. The apparatus of claim 12, further comprising at least one fastening element coupling each of the outer segments with the respective one of the inner segments.

14. The apparatus of claim 13, wherein the at least one fastening element is received in a bore formed in the outer segment.

15. The apparatus of claim 14, wherein each of the outer segments comprises a drainage conduit extending between top and bottom surfaces of the outer segment, and the drainage conduit is in communication with the bore.

16. The apparatus of claim 12, wherein each of the outer segments is biased outwardly with respect to the central pillar.

17. The apparatus of claim 16, further comprising at least one spring element arranged between each of the outer segments and the respective one of the inner segments to bias the outer segment outwardly.

18. The apparatus of claim 1, wherein each of the channels comprises a beveled top opening to facilitate loading of the objects into the channels.

19. The apparatus of claim 1, further comprising a second annular space that extends around the central pillar between the central pillar and the inner segments.

20. The apparatus of claim 1, further comprising a radial gap extending between each of the pairs of segments and an adjacent pair.

21. The apparatus of claim 20, wherein each of the outer segments comprises chamfered side faces, so that the radial gap extends radially outwardly into a generally triangular passage.

22. The apparatus of claim 1, wherein the central pillar comprises a drainage passage extending between the top and bottom ends.

23. The apparatus of claim 22, wherein the central pillar comprises a plurality of drainage ports extending generally radially between the drainage passage and an outer surface adjacent to the inner segments.

24. The apparatus of claim 22, wherein the top end of the central pillar is adapted for attachment to a handling tool.

25. The apparatus of claim 1, wherein:

each of the inner segments is adapted to move generally radially with respect to the central pillar;

each of the inner segments is biased outwardly with respect to the central pillar;

each of the outer segments is adapted to move generally radially with respect to the central pillar;

each of the outer segments is biased outwardly with respect to the central pillar; and further comprising at least one first spring element arranged between each of the inner segments and the central pillar to bias the inner segments outwardly, and at least one second spring element arranged between each of the outer segments and the respective one of the inner segments to bias the outer segment outwardly.

* * * * *